US006179412B1

(12) United States Patent
Ishinaga et al.

(10) Patent No.: US 6,179,412 B1
(45) **Date of Patent: *Jan. 30, 2001**

(54) LIQUID DISCHARGING HEAD, HAVING OPPOSED ELEMENT BOARDS AND GROOVED MEMBER THEREBETWEEN

(75) Inventors: Hiroyuki Ishinaga, Tokyo; Hiroshi Sugitani, Machida; Jun Kawai, Tokyo; Masaaki Okada, Sanjo, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/713,454

(22) Filed: Sep. 13, 1996

(30) Foreign Application Priority Data

Sep. 14, 1995 (JP) ..... 7-237097

(51) Int. Cl.[7] ..... B41J 2/05
(52) U.S. Cl. ..... 347/63
(58) Field of Search ..... 347/63, 56, 54, 347/20, 100, 96, 98, 71, 40, 101, 45, 46, 47

(56) References Cited

U.S. PATENT DOCUMENTS

| | | | | |
|---|---|---|---|---|
| 3,988,745 | * | 10/1976 | Sultan | 347/71 |
| 4,313,124 | | 1/1982 | Hara | 346/140 R |
| 4,345,262 | | 8/1982 | Shirato et al. | 346/140 R |
| 4,367,480 | * | 1/1983 | Kotoh | 347/71 |
| 4,380,771 | * | 4/1983 | Takatori | 347/44 |
| 4,412,224 | | 10/1983 | Sugitani | 346/1.1 |
| 4,417,251 | | 11/1983 | Sugitani | 346/1.1 |
| 4,437,100 | | 3/1984 | Sugitani et al. | 346/1.1 |
| 4,450,455 | | 5/1984 | Sugitani et al. | 346/140 R |
| 4,459,600 | | 7/1984 | Sato et al. | 346/140 R |
| 4,463,359 | | 7/1984 | Ayata et al. | 346/1.1 |
| 4,509,063 | | 4/1985 | Sugitani et al. | 346/140 R |
| 4,521,787 | | 6/1985 | Yokota et al. | 346/140 R |
| 4,558,333 | | 12/1985 | Sugitani et al. | 346/140 R |
| 4,608,577 | | 8/1986 | Hori | 346/140 R |
| 4,611,219 | | 9/1986 | Sugitani et al. | 346/140 R |
| 4,666,823 | | 5/1987 | Yokota et al. | 430/320 |
| 4,723,129 | | 2/1988 | Endo et al. | 346/1.1 |
| 4,740,796 | | 4/1988 | Endo et al. | 346/1.1 |
| 5,103,246 | | 4/1992 | Dunn | 346/140 R |
| 5,148,192 | | 9/1992 | Izumida et al. | 346/140 R |

(List continued on next page.)

FOREIGN PATENT DOCUMENTS

| | | |
|---|---|---|
| 2843064 | 4/1979 | (DE) . |
| 0581135 | 2/1994 | (EP) . |
| 0603901 | 6/1994 | (EP) . |
| 2134041 | 8/1984 | (GB) . |
| 54-051837 | 4/1979 | (JP) . |
| 54-56847 | 5/1979 | (JP) . |
| 59-123670 | 7/1984 | (JP) . |
| 59-131466 | 7/1984 | (JP) . |
| 59-138461 | 8/1984 | (JP) . |
| 60-71260 | 4/1985 | (JP) . |

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid discharging head for discharging liquid from discharge ports, comprises first and second element boards provided in mutually opposed manner and bearing thereon a plurality of energy generating elements for generating energy for liquid discharge and a grooved member positioned between said mutually opposed first and second element boards and provided with grooves for forming liquid flow paths respectively corresponding to said energy generating elements in combination with said first element board, grooves for forming liquid flow paths respectively corresponding to said energy generating elements in combination with said second element board, and discharge ports communicating with said liquid flow paths.

18 Claims, 7 Drawing Sheets

U.S. PATENT DOCUMENTS

| | | | |
|---|---|---|---|
| 5,175,565 | 12/1992 | Ishinaga et al. | 346/140 R |
| 5,371,528 | 12/1994 | Izumida et al. | 347/87 |
| 5,389,957 | 2/1995 | Kimura et al. | 347/20 |
| 5,485,184 | 1/1996 | Nakagomi et al. | 347/63 |
| 5,549,740 * | 8/1996 | Takahashi et al. | 347/101 |
| 5,835,110 * | 11/1998 | Sasaki | 347/40 |

* cited by examiner

LIQUID DISCHARGING HEAD, HAVING OPPOSED ELEMENT BOARDS AND GROOVED MEMBER THEREBETWEEN

BACKGROUND OF THE INVENTION

1. Field of the Invention

The present invention relates to a liquid discharging head for effecting printing by discharging printing (recording) liquid from a discharge port by means of thermal energy, and a liquid discharging apparatus utilizing such head. The above-mentioned printing includes ink application onto various kinds of ink substrate capable of receiving ink, such as cloth, fiber, paper and sheet material, and the above-mentioned apparatus includes all the information processing apparatus and printers serving as the output apparatus for such information processing apparatus, and the present invention is applicable to such printing or apparatus.

2. Related Background Art

Ink jet printing method is recently attracting attention because of its features that the noise at the printing operation can be reduced to a negligible level, that high-speed printing operation is possible and that image fixation on so-called plain paper is possible without particular treatment.

Among such ink jet printing technologies, the ink jet printing method disclosed for example in the Japanese Patent Laid-Open Application No. 54-51837 and the German Patent Laid-Open Application (DOLS) 2843064 is different from other ink jet printing methods, in that the driving force for ink discharge is obtained by applying thermal energy to liquid.

More specifically, in the ink jet printing method disclosed in the above-mentioned patent applications, the liquid effected by thermal energy undergoes a state change involving a rapid volume change, and is discharged from an orifice at the front end of a printing head, by the force generated by such state change. The discharged liquid forms a flying droplet, which is deposited onto a printing material to perform recording.

In particular, the ink jet printing method disclosed in the above-mentioned DOLS 2843064 is not only extremely advantageously applicable to so-called drop-on-demand printing method, but also has the advantage of providing a high-quality image of a high resolving power at a high speed, since a full-line head with multiple orifices arranged at a high density can be easily realized.

The printing head employed in the above-mentioned ink jet printing methods is composed, as shown in FIG. 1, of an ink discharge unit including orifices (discharge ports) 206 for discharging liquid droplets, plural nozzles 204 communicating with the orifices 206, provided in a part thereof with heat action portions where the thermal energy for liquid discharge is applied to the liquid and divided by flow path walls 203, and a common liquid chamber for supplying the nozzles 204 with recording liquid, electrothermal converting members (heat generating members) 202 serving as means for generating thermal energy, and a printing head substrate 201 provided with a wiring portion 209 for supplying the heat generating members 202 with electric currents. The liquid is supplied to the common liquid chamber 207 from an unrepresented liquid reservoir tank through a supply pipe 208.

In such conventional ink jet printing technologies, the ink jet recording head utilizing pigment ink has been associated with the drawbacks that the ink is of a limited pot life as it tends to solidify by the coagulation of the pigment component, that the response frequency of ink discharge cannot be made high because of the high viscosity of ink, and that the time required for image fixation is extremely long because of poor permeability of such ink into the recording paper. It has been tried to overcome such drawbacks by reducing the pigment concentration or by employing a solvent of higher permeability, but such measures result in a loss in the recording density or blotting of the ink on the recording paper and are not effective sufficiently.

On the other hand, the Japanese Patent Laid-Open Application proposes an ink jet recording method of superposing the recording ink and a process liquid for improving the image quality, storage durability and liquid permeability. In this proposed method, the color ink jet recording apparatus is provided with separate drum-structured heads.

In such recording method, however, the image quality, image fixation and image durability become significantly deteriorated if the hit position of the processing liquid is displaced even slightly from that of the recording ink. In particular, in the above-mentioned conventional configuration in which the head for the processing liquid and that for the recording ink are formed separately, the components of the recording heads and of the printer main body, particularly the carriage unit thereof, have to be highly precisely prepared in order to match the his positions of the processing liquid and the recording ink, thus leading to a higher cost. Also these parts require an enormously long time for the adjustment, and, for these reasons, such ink jet printer is much more expensive in cost than the ordinary ink jet printers. These drawbacks are particularly conspicuous in the printer in which the user can replace the recording heads. Also it will be easily understood that the printing speed cannot be much improved even if the response speed is increased. These drawbacks are similarly encountered also in the recording method in which inks of different kinds are to be deposited on a same hit position.

SUMMARY OF THE INVENTION

A first object of the present invention is to provide a liquid discharging head capable of high-quality recording with a high speed, by precisely matching reaching positions of inks of different kinds or of processing liquid and ink.

A second object of the present invention is to provide an ink jet printing apparatus capable of mounting a liquid discharging head capable of high-quality recording with a high speed, by precisely matching the reaching positions of inks of different kinds or of processing liquid and ink.

The above-mentioned objects can be attained, according to the present invention, by a liquid discharging head comprising first and second element boards provided with a plurality of energy generating elements for generating energy for liquid discharge and positioned in mutually opposed manner, and a grooved member positioned between the first and second element boards and provided with grooves for forming liquid flow paths respectively corresponding to the energy generating elements in combination with the first element board, grooves for forming liquid flow paths respectively corresponding to the energy generating elements in combination with the first element board and discharge ports respectively communicating with the liquid flow paths.

There is also provided a liquid discharging head cartridge including the liquid discharging head mentioned above and a liquid reservoir containing ink to be supplied to the liquid discharging head.

There is also provided a liquid discharging apparatus including the liquid discharging head mentioned above and means for detachably supporting the liquid discharging head.

The liquid discharging head, the liquid discharging head cartridge and the liquid discharging apparatus of the present invention can provide an image of extremely high quality, firm fixation and high durability because of the absence of aberration between the reaching positions of liquids of two kinds, as the nozzles for the two liquids are integrally formed by a single grooved member.

Also the manufacturing cost of the liquid discharging head and of the entire printing apparatus can be reduced, by an integral configuration of the nozzles for the discharge of the two liquids.

BRIEF DESCRIPTION OF THE DRAWINGS

FIGS. 2A and 2B are views of an embodiment of the liquid discharging head of the present invention, wherein FIG. 2A is a cross-sectional view showing the internal structure of the head and FIG. 2B is an elevational view of the head seen from the side of discharging openings;

DESCRIPTION OF THE PREFERRED EMBODIMENTS

Now the present invention will be clarified in detail by preferred embodiments thereof, with reference to the attached drawings.

Figure 2A:
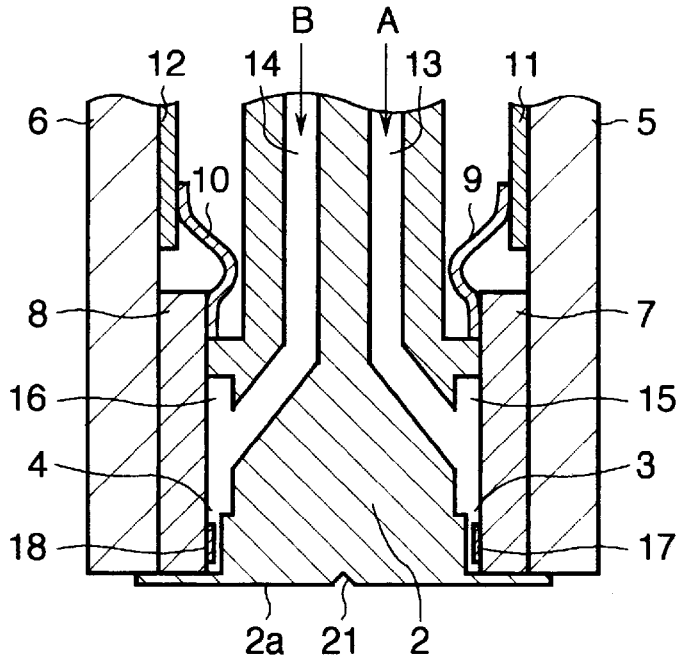
Figure 2B:
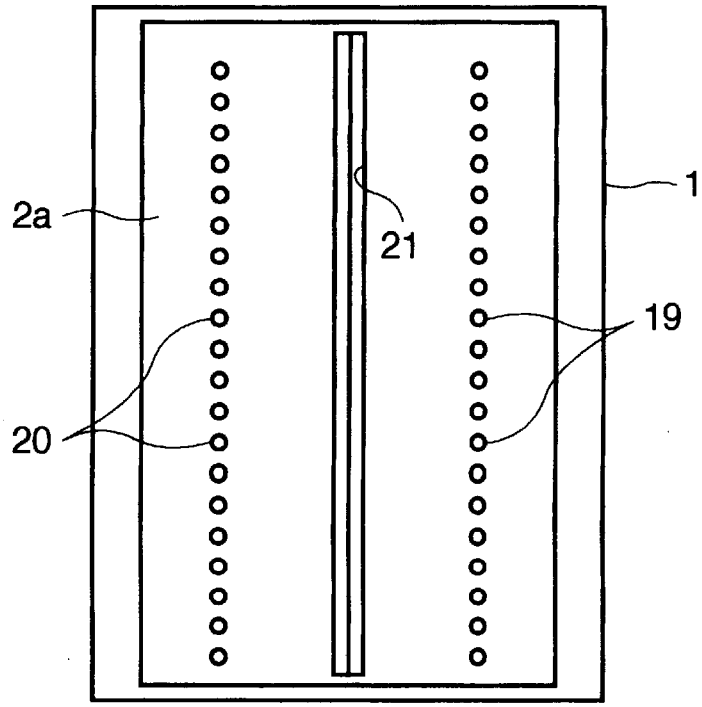
Figure 3:
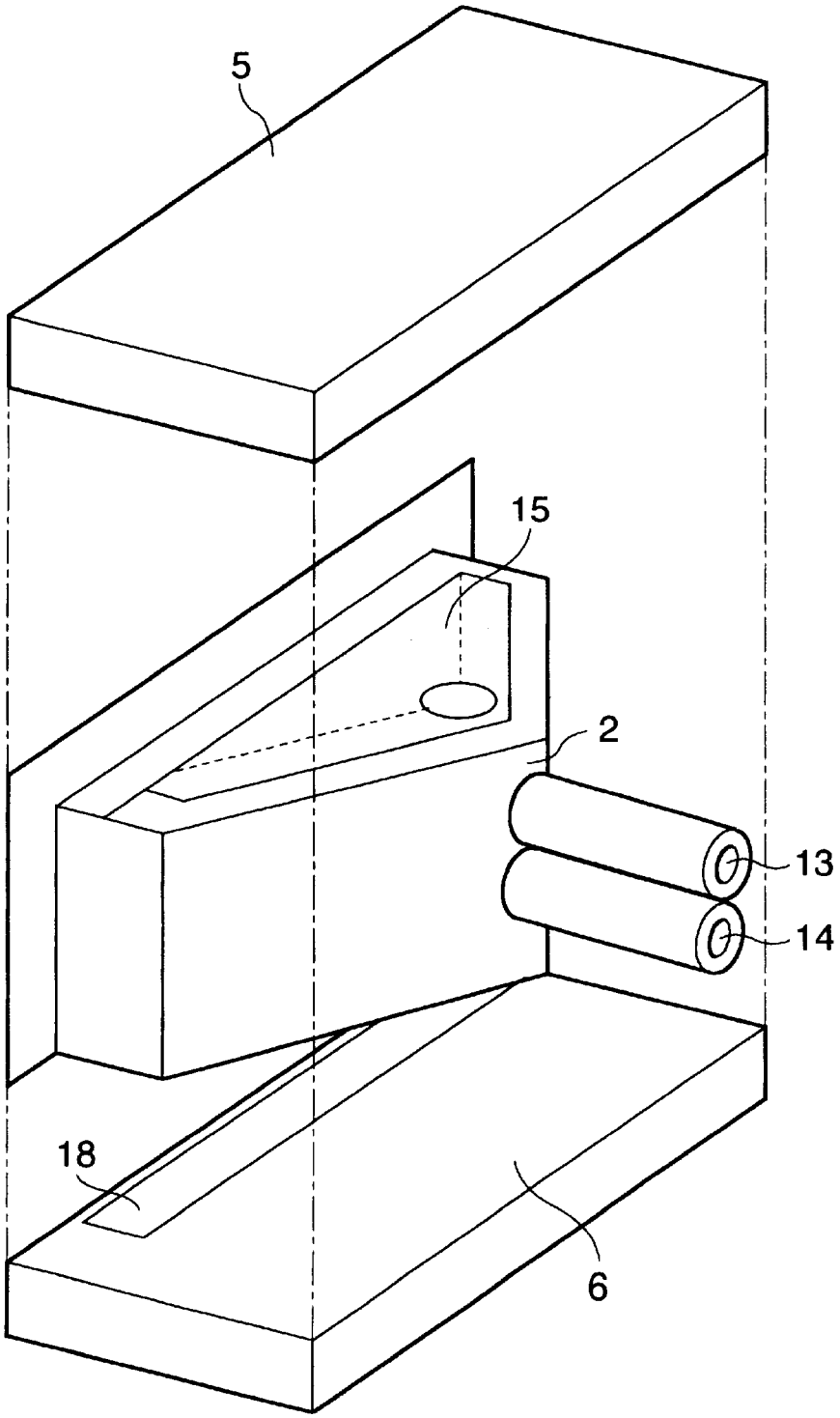
FIG. 3 is an exploded perspective view of the liquid discharging head shown in FIGS. 2A and 2B, showing the external structure thereof seen from the side of liquid flow paths.

FIGS. 2A and 2B show an embodiment of the liquid discharging head (ink jet head) of the present invention, wherein FIG. 2A is a cross-sectional view showing the internal structure thereof and FIG. 2B is an elevational view showing the external structure seen from the side of an orifice face. Also FIG. 3 is a exploded perspective view showing the external structure of the ink jet head shown in FIGS. 2A and 2B, seen from the side of liquid flow paths.

Referring to FIGS. 2A and 2B, the ink jet head 1 is principally composed of a cover plate (grooved member) 2 provided with ink supply paths 13, 14 for respectively supplying nozzles 3, 4 with recording ink A and processing liquid B, plural grooves for constituting the nozzles (liquid flow paths), recesses constituting common liquid chambers 15, 16 for such liquids and orifices (discharge ports) 19, 20; and two heater boards (element boards), 7, 8 sandwiching the cover plate 2 on both faces thereof. The mutually contacting arrangement of the cover plate 2 and the heater boards (element boards) 7, 8 defines therebetween the nozzles 3, 4 and the common liquid chambers 15, 16 for respectively receiving the recording ink A and the processing liquid B from the ink supply paths 13, 14 and supplying the recording ink A and the processing liquid B to the nozzles 3, 4. On the outer faces of the heater boards 7, 8 there are respectively adhered base plates 5, 6 shown in FIG. 3. The heater boards 7, 8 are provided, in portions thereof facing the nozzles, with electrothermal converting elements 17, 18 serving as energy generating elements for heating the liquid to generate bubbles therein and discharging the liquids of the nozzles 3, 4 from the orifices 19, 20 by the pressure of such bubbles. The heater boards 7, 8 also receive electrical energy and discharge control signals from printed circuit boards 11, 12 through wires 9, 10.

On a face 2*a* of the cover plate 2 there are formed respective arrays of the orifices 19, 20, between which provided is a groove 21 for preventing the mixing of the liquid, along the direction of arrays of the orifices. Such mixing preventive means is not limited to a groove but can be of any shape capable of preventing mutual mixing of two liquids, such as a protruding portion.

Such orifices 19, 20 can be prepared with a high positional precision with an error not exceeding several micrometers, since they can be simultaneously formed on the face 2*a* for example by laser milling or photoetching.

A recording head for discharging different liquids can be prepared in very compact and inexpensive manner by positioning, as explained above, the grooved member between the plural element boards provided in mutually opposed manner. Also since the grooved member is in advance provided with the discharge ports corresponding to the respective element boards, the shape and the arrangement of such discharge ports are not affected by the preparation process of the liquid flow paths, based on the mutual adhesion of the grooved member and the element board. It is therefore possible to drastically improve the accuracy of the reaching positions of the different liquids.

Furthermore, the grooved member is provided with recesses constituting the common liquid chambers, in addition to the discharge ports and the grooves for constituting the liquid flow paths corresponding to the elements of the element boards, so that the number of components can be further reduced and there can be obtained a liquid discharging head with improved performance and with a reduced cost.

The above-mentioned grooved member, being sandwiched between the plural element boards, may be deformed by the heat transmitted therefrom in certain drive state, for example if the elements are activated without the liquid discharge. Such drawback can however be avoided by positioning, as in the present invention, the base plates (heat dissipating members) 5, 6 of a material having a high thermal conductivity and a high heat dissipating effect, for example a metal such as aluminum, copper or stainless steel, outside the element boards. Naturally such heat dissipating members can be dispensed with if the amount of generated heat is small and the grooved member is free of fear of deformation.

Also in the liquid discharging head of the present invention, the wires 9, 10 for electrical connection between the element boards and the circuit boards 11, 12 are positioned inside the mutually opposed base plates, so that the electrical connecting portions can be protected from the external influence.

Figure 1:
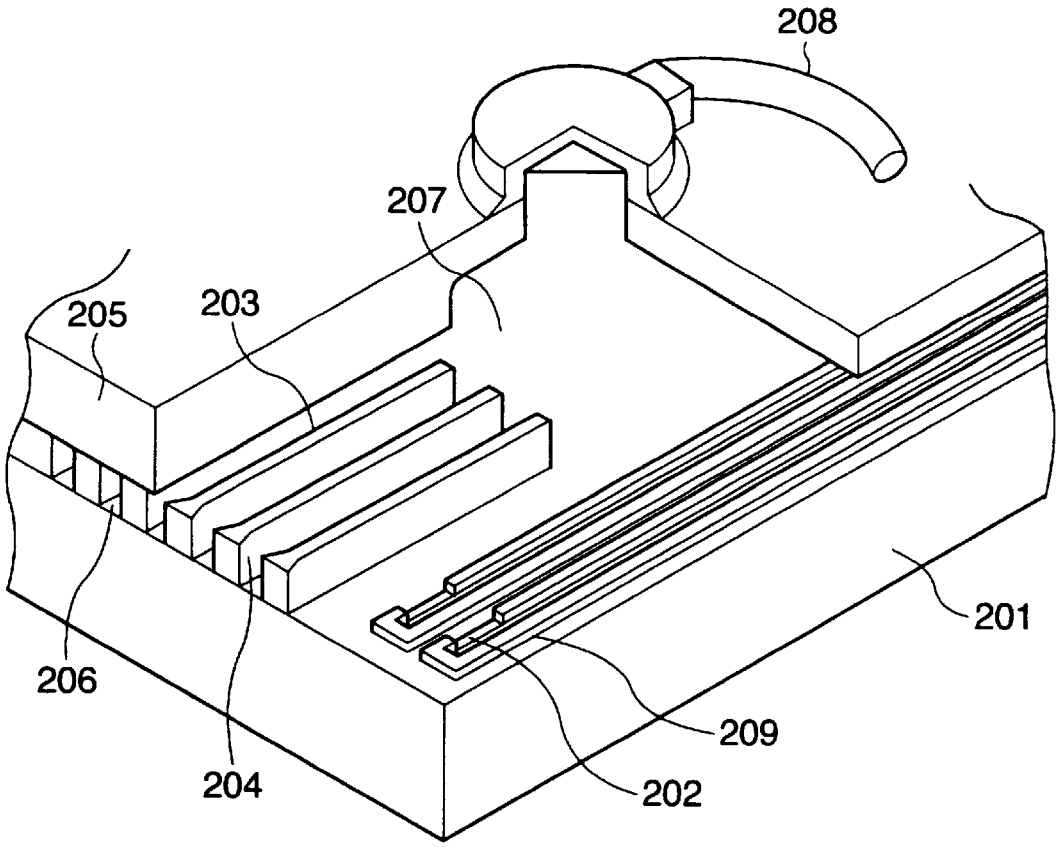
FIG.1 PRIOR ART
FIG. 1 is a perspective view of a conventional ink jet recording head, partially cut off for showing the internal structure.
Figure 4:
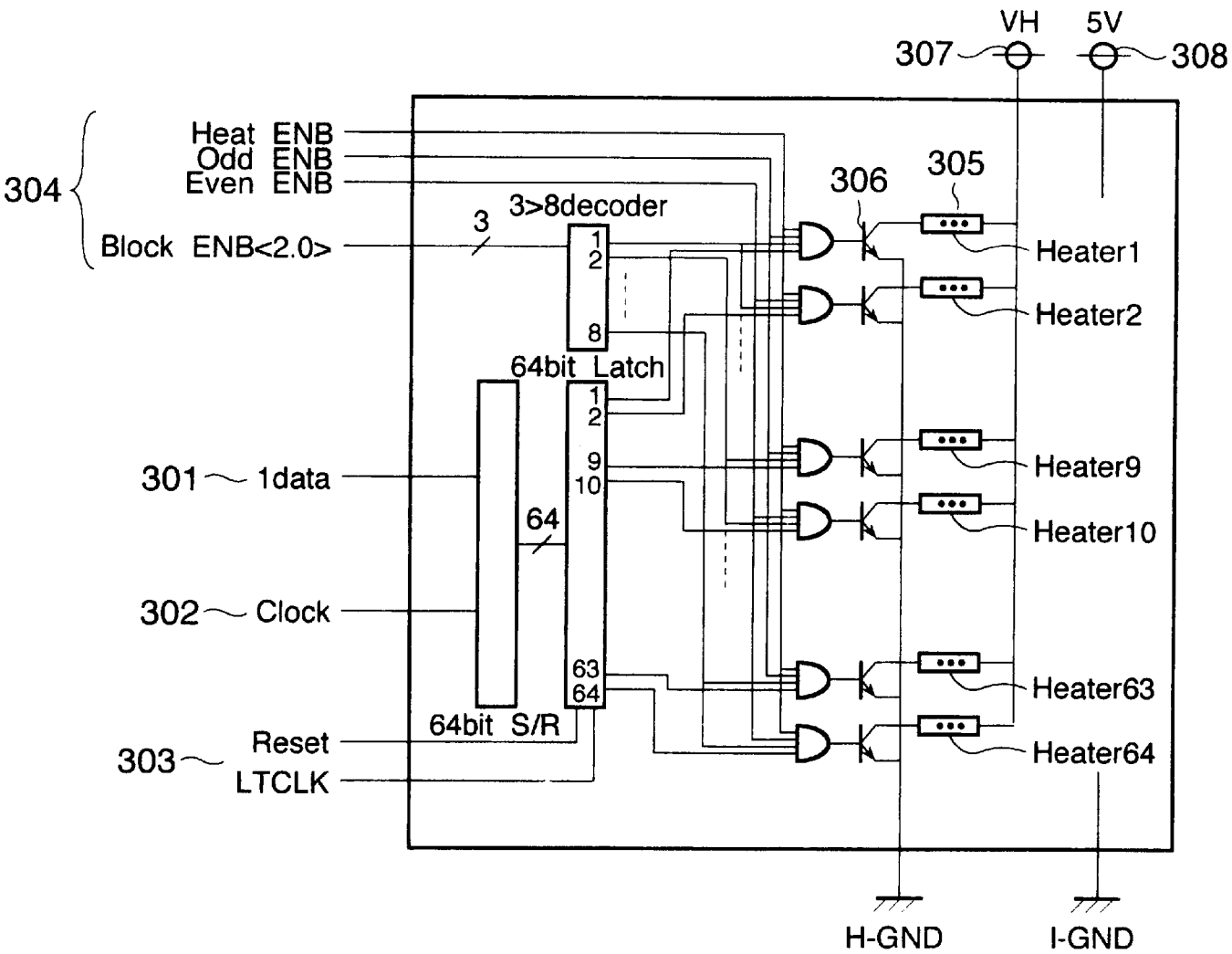
FIG. 4 is an equivalent circuit diagram of an element board constituting the liquid discharging head.

FIG. 4 is a plan view showing the circuits formed on the base plates 5, 6 of the ink jet head shown in FIGS. 1, 2A and 2B, in an equivalent circuit diagram.

In FIG. 4, there are shown an input image data 301, a clock signal 302 for data transferring shift register, a latch signal 303 for latching the data of the shift register, enable signals 304 for determining the width and timing of printing pulses, electrothermal converting elements 305 serving as the energy generating elements, driving transistor 306, a power source 307, and a logic power source 308.

In the following there will be explained the image forming method with the above-explained ink jet head, with reference FIGS. 5A to 5D which are lateral views showing an example of discharging method for the recording ink and the processing liquid by the ink jet head shown in FIGS. 2A, 2B and 3.

Figure 5A:
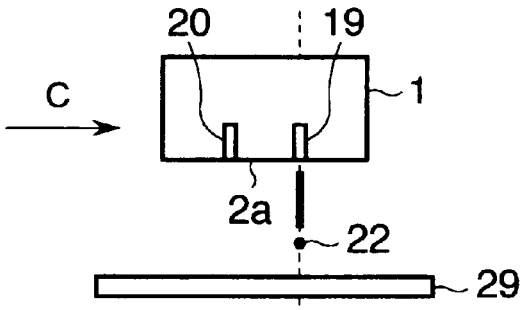
FIGS. 5A to 5D are views showing the method of liquid discharge in case of employing ink and processing liquid as the different liquids.

At first, as shown in FIG. 5A, the ink jet head 1 in the course of a scanning motion in a direction C discharges the processing liquid from the orifice 19 to a predetermined position on a recording sheet 29 constituting the recording medium.

Figure 5B:
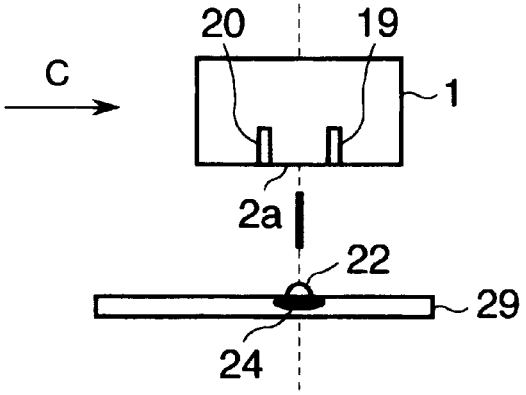

The discharged droplet 22 of the processing liquid hits the recording sheet 29 as shown in FIG. 5B and penetrates therein, thus forming a dot 24. The processing liquid has a very low surface tension not exceeding about 30 dyn/cm, in order to promptly penetrate in the recording sheet 29 thereby forming a large dot. As the liquid of such physical property can provide a sufficiently large dot with a liquid volume which is about a half of that of the ordinary recording ink, the nozzles are so designed to have appropriate discharging characteristics matching such physical property.

Figure 5C:
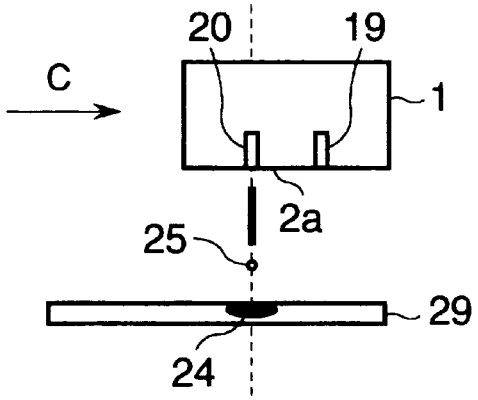

Then, as shown in FIG. 5C, the ink jet head 1 continues to move in the direction C and discharges the recording ink from the orifice 20 toward the dot 24 formed on the recording sheet 29.

Figure 5D:
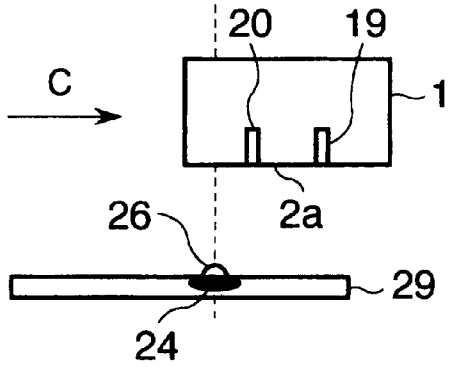

The droplet 25 of the recording ink securely lands on the dot 24 as shown in FIG. 5D to form a dot 26, in which a rapid coagulating reaction takes place by the mixing of both liquids, whereby the recording ink is securely fixed and a high-quality image can be obtained.

In the following there will be explained the positional relationship of two arrays of the orifices in a cover plate in the present embodiment, with reference to FIGS. 6A and 6B.

Figure 6A:
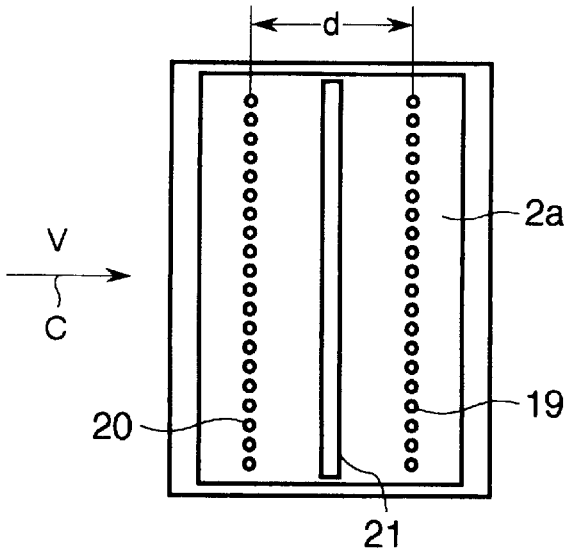
FIGS. 6A and 6B are schematic views showing the relationship between the arrangement of array of the discharge ports and the scanning direction of the liquid discharging head.

In an example shown in FIG. 6A, on the orifice face 2*a* of the cover plate 2, an array of the orifices 19 for the processing liquid and an array of the orifices 20 for the recording ink are formed in mutually parallel manner, with a mutual distance d. The velocity V of the ink jet head 1 in the moving direction C relative to the recording sheet is related with the distance d of the orifice arrays and the discharge frequency $f_{op}$ by a relation $V/d=f_{op}$, and the reaching positions of the liquid droplets from the respective orifices can be matched by forming the orifices 19 and 20 along the moving line of the head.

Figure 6B:
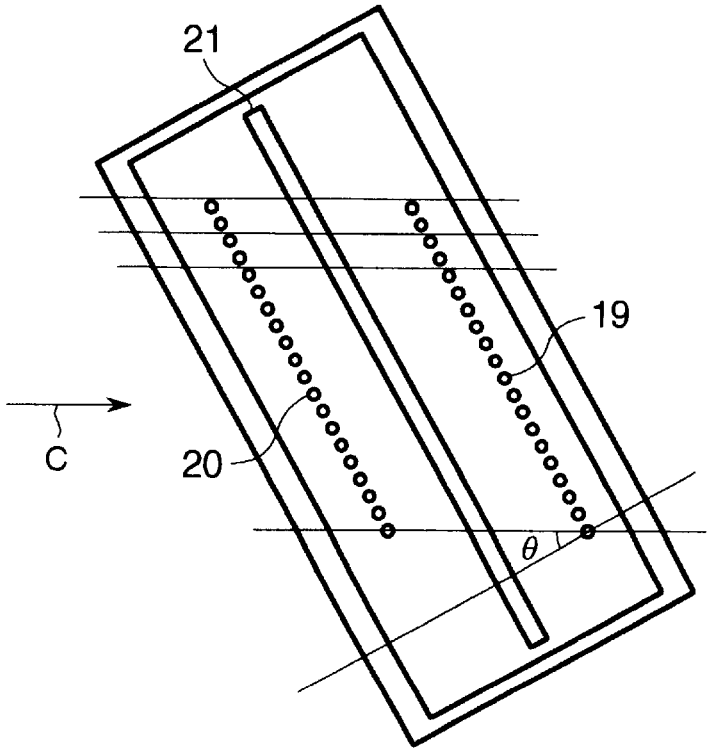

In an example shown in FIG. 6B, the array of the orifices 19 and the array of the orifices 20 are inclined by an angle θ to the moving direction C of the ink jet head 1 relative to the recording sheet, and the array of the orifices 19 is displaced, relative to the array of the orifices 20, by $d \cdot \tan\theta$ along the direction of the arrays.

Such configuration allows, in comparison with the configuration shown in FIG. 6A, to increase the recording density and to improve the refilling performance. Also the reaching positions of the liquid droplets from the respective orifices can be matched by so selecting the timing of liquid discharge as to satisfy a relationship $V/(d/\cos\theta)=f_{op}$.

In the foregoing explanation of the ink jet head, the different liquids to be employed therein are assumed to processing liquid and recording ink, but the present invention is not limited to such case and is likewise applicable to a case of employing inks of different kinds. As an example of such case, there may be employed inks of different colors for obtaining a mixed color, and there can be prevented the change in color resulting from the aberration in the reaching positions.

Figure 7:
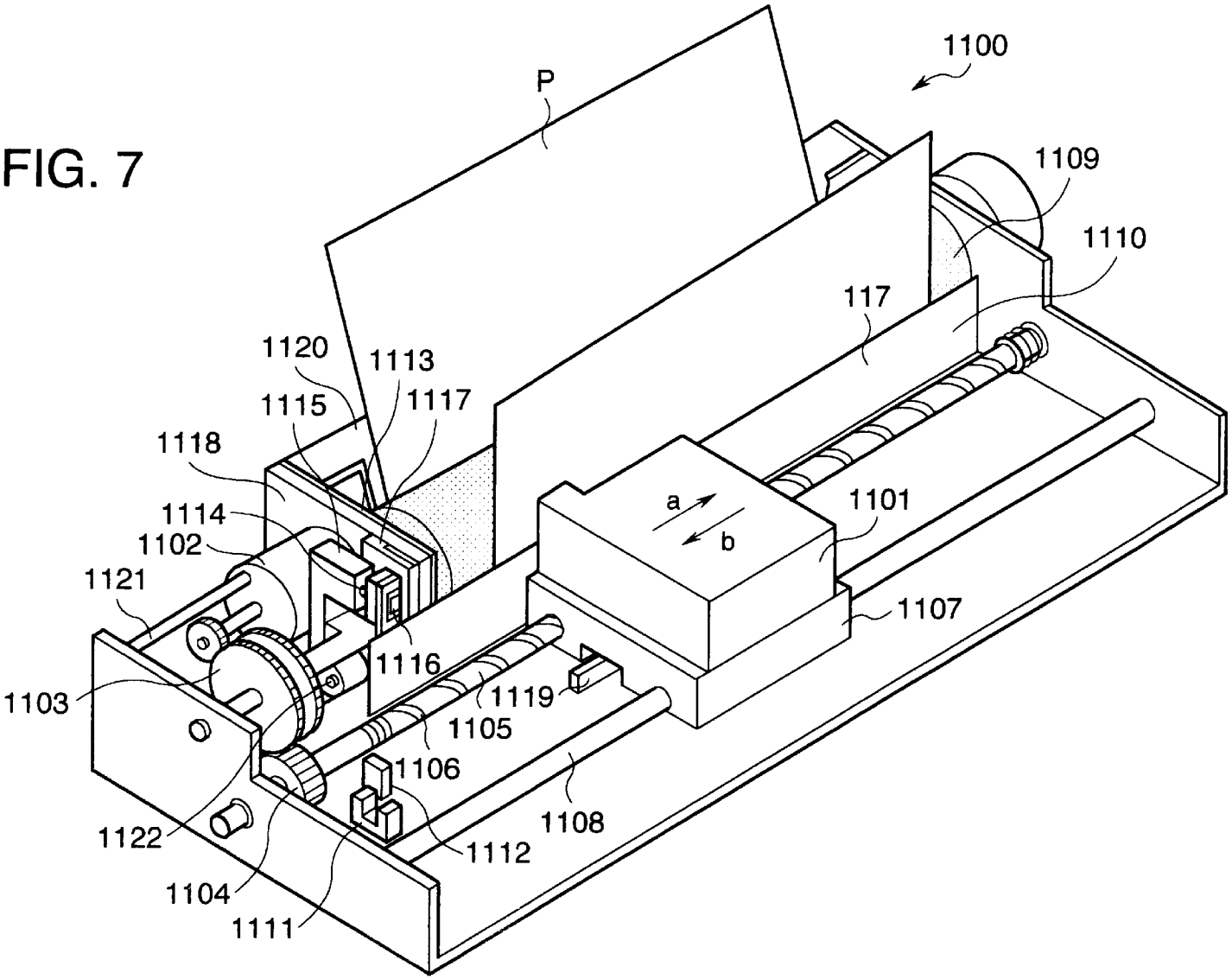
FIG. 7 is a perspective view of a liquid discharging apparatus capable of mounting the liquid discharging head of the present invention.

FIG. 7 is a schematic perspective view of an ink jet printing apparatus in which the ink jet printing head of the foregoing embodiment can be mounted.

A liquid discharging head cartridge 1101 includes the printing head of the foregoing embodiment and an ink container containing ink to be supplied thereto. The head cartridge 1101 is mounted on a carriage 1107 engaging with a spiral groove 1106 of a lead screw 1105 which is rotated by a driving motor 1102 in forward and reverse directions through transmitting gears 1103, 1104, and is reciprocated in directions a and b, together with the carriage 1107, by the driving force of the motor 1102. A paper support plate 1110, for a printing sheet P transported by an unrepresented printing sheet supply unit over a platen 1109, presses the printing sheet P toward the platen 1109 along the moving direction of the carriage.

In the vicinity of an end of the lead screw 1105, there is provided a photocoupler 1111, 1112 constituting home position detecting means, for detecting the presence of a lever 1119 of the carriage 1107 in this area and accordingly switching the rotating direction of the driving motor. A support member 1113 supports a cap member 1114 for covering a face, containing orifices 304, of the printing head 1101. Ink suction means 1115 is provided for sucking ink, from the head 1101, into the interior of the cap member 1114, thereby effecting suction recovery of the head 1101 through an aperture 1016 provided in the cap member. A cleaning blade 1117 and a moving member 1118, supporting the cleaning blade 1117 movably in front-rear direction (perpendicular to the moving direction of the carriage 1107), are supported by a support plate 1120 of the main body. A lever 1121 for starting the suction operation for the suction recovery, to be moved by a cam 112 engaging with the carriage 1107, is controlled by the driving force of the driving motor, transmitted through known transmission means such as a clutch. A print control unit for providing the heat generating elements in the head 1101 with the print signals and for controlling the function of the above-mentioned units is provided in the printer main body and is therefore not illustrated in the drawing.

The printer 1100 of the above-explained configuration effects recording, on the printing sheet P transported over the platen 1109 by the unrepresented print sheet supply unit, by reciprocating motion of the head 1101 over the entire width of the printing sheet, and, the head 1101, being capable of high-density recording, can achieve high-speed printing operation with a high precision.

In the present invention, the ink to be used is not limited to dye-based ink but may be pigment-based ink containing dispersed pigment, and the processing liquid to be used may be of a kind causing coagulation of such pigment. Further, there may be employed, in combination, different inks for example of different colors, as will be explained later. In the following there will be shown an example of pigment ink that causes coagulation upon mixing with colorless liquid. More specifically, inks of yellow, magenta, cyan and black colors Y2, M2, C2, K2, each containing a pigment and an anionic compound, can be obtained in the following manner.

Black ink K2

Utilizing anionic polymer P-1 (styrene-methacrylic acid-ethyl acrylate, acid value 400, weight-averaged molecular weight 6,000, aqueous solution with a solid content of 20%, neutralized with potassium hydroxide) as dispersant, the following materials were changed in a batch-type vertical sand mill (manufactured by Imex Co.) together with glass beads of a diameter of 1 mm as media, and the dispersion treatment was conducted for 3 hours under cooling with water. After the dispersion, the viscosity was 9 cps and pH was 10.0. The obtained dispersion was subjected to the removal of coarse particles by a centrifuge, whereby obtained was carbon black dispersion with a weight-averaged particle size of 100 nm.

| (Composition of carbon black dispersion) | |
|---|---|
| P-1 aqueous solution (solid content 20%) | 40 parts |
| carbon black Mogul L (supplied by Cablac) | 24 parts |
| glycerin | 15 parts |
| ethylene glycol monobutylether | 0.5 parts |
| isopropyl alcohol | 3 parts |
| water | 135 parts |

Thus obtained dispersion was sufficiently dispersed to provide pigment-containing black ink K2 for ink jet recording, with a final solid content of ca. 10%.

Yellow ink Y2

Utilizing anionic polymer P-2 (styrene-methacrylic acid-methyl methacrylate, acid value 280, weight-averaged molecular weight 11,000, aqueous solution with a solid content of 20%, neutralized with diethanolamine) as dispersant, the following materials were subjected to dispersing treatment as in the case of preparation of the black ink K2, whereby obtained was yellow dispersion with a weight-averaged particle size of 103 nm.

| (Composition of yellow dispersion) | |
|---|---|
| P-2 aqueous solution (solid content 20%) | 35 parts |
| C.I. pigment yellow 180 (Nova Palm Yellow PH-G supplied by Ciba-Geigy Co.) | 24 parts |
| triethyleneglycol | 10 parts |
| diethyleneglycol | 10 parts |
| ethylene glycol monobutylether | 1.0 parts |
| isopropyl alcohol | 0.5 parts |
| water | 135 parts |

Thus obtained dispersion was sufficiently dispersed to provide pigment-containing yellow ink Y2 for ink jet recording, with a final solid content of ca. 10%.

Cyan ink C2

Utilizing anionic polymer P-1, employed in the preparation of the black ink K2, as dispersant, the following materials were subjected to dispersing treatment as in the case of preparation of the carbon black dispersion, whereby obtained was cyan dispersion with a weight-averaged particle size of 120 nm.

| (Composition of cyan dispersion) | |
|---|---|
| P-1 aqueous solution (solid content 20%) | 30 parts |
| C.I. pigment blue 15:3 (Fastgen Blue FGF supplied by Dai-nippon Ink Chemical Co.) | 24 parts |
| glycerin | 15 parts |
| diethylene glycol monobutylether | 0.5 parts |
| isopropyl alcohol | 3 parts |
| water | 135 parts |

Thus obtained dispersion was sufficiently dispersed to provide pigment-containing cyan ink C2 for ink jet recording, with a final solid content of ca. 9.6%.

Magenta ink M2

Utilizing anionic polymer P-1, employed in the preparation of the black ink K2, as dispersant, the following materials were subjected to dispersion treatment as in the case of preparation of the carbon black dispersion, whereby obtained was magenta dispersion with a weight-averaged particle size of 115 nm.

| (Composition of magenta dispersion) | |
|---|---|
| P-1 aqueous solution (solid content 20%) | 20 parts |
| C.I. pigment red 122 (supplied by Dai-Nippon Ink and Chemicals) | 24 parts |
| glycerin | 15 parts |
| isopropyl alcohol | 3 parts |
| water | 135 parts |

Thus obtained dispersion was sufficiently dispersed to provide pigment-containing magenta ink M2 for ink jet recording, with a final solid content of ca. 9.2%.

The processing liquid for insolubilizing the ink dye can for example be prepared in the following manner.

The following components were dissolved by mixing, and the obtained solution was filtered under a pressure with a membrane filter of a pore size of 0.22 $\mu$m (trade name Fluoropore Filter, manufactured by Sumitomo Denko Co.), and was subjected to pH adjustment to 4.8 with NaOH to obtain processing liquid A1.

| (Composition of Al) | |
|---|---|
| Low molecular component of cationic compound: | |
| stearyltrimethylammonium chloride (trade name Electrostopper QE, manufactured by Kao Corporation) | 2.0 parts |
| High molecular component of cationic compound: | |
| polyaminesulfone (average molecular weight 5,000) (trade name PAS-92, manufactured by Nitto Boseki) | 3.0 parts |
| thiodiglycol | 10 parts |
| water | remainder |

Preferred examples of ink which is insolubilized upon mixing with the above-mentioned processing liquid can be obtained in the following manner.

Following components were mixed and filtered with a membrane filter of a pore size of 0.22 $\mu$m (trade name Chloropore Filter, manufactured by Sumitomo Electric Industried Ltd.), to obtain yellow, magenta, cyan and black inks Y1, M1, C1, K1.

Y1

| | |
|---|---|
| C.I. direct yellow 142 | 2 parts |
| thiodiglycol | 10 parts |
| acetylenol EH (Kawaken Fine Chemical Co.) | 0.05 part |
| water | remainder |

M1

Same composition as Y1 except that the dye was replaced by 2.5 parts of C.I. acid red 289.

C1

Same composition as Y1 except that the dye was replaced by 2.5 parts of C.I. acid blue 9.

K1

Same composition as Y1 except that the dye was replaced by 2.5 parts of C.I. food black 2.

When the processing liquid and the ink are mixed, the mixing takes place in the present invention on the printing material or in a position after permeation into the printing material, and, as a first step of the reaction, the low-molecular weight component of the cationic substance or the cationic oligomer contained in the processing liquid causes association by ionic interaction with the water-soluble dye having an anionic radical, contained in the ink, or the anionic compound contained in the pigment ink, thereby causing instantaneous separation from the liquid phase. As a result, in case of pigment ink, the dispersion state is destroyed to generate coagulated body of pigment.

Then, as a second step of the reaction, the above-mentioned associated body of the dye and the low-molecular cationic substance or the cationic oligomer or the coagulated body of pigment is absorbed by the high-molecular component contained in the processing liquid, whereby the associated body of dye or the coagulated body of pigment further grows in size and becomes harder to penetrate in the gaps between the fibers of the printing material. As a result, the liquid part only after solid-liquid separation penetrates into the recording sheet, whereby the high print quality and the image fixation are both achieved. Besides, the coagulated body formed by the low-molecular component of the cationic substance or the cationic oligomer and the anionic dye or the coagulated body of pigment, formed by the above-explained mechanism, is highly viscous and does not move together with the movement of the liquid part. Consequently the adjacent ink dots, composed of inks of different colors for example in case of full-color image formation, do not mix mutually and are kept free of bleeding. Furthermore the above-mentioned coagulated or associated body is essentially insoluble in water, thus providing the formed image with satisfactory water resistance. In addition, the light fastness of the formed image is improved by the shielding effect of the polymer.

The insolubilization or coagulation explained in the present specification partly relies only on the first step mentioned above, and partly on both the first and second steps.

Also the present invention allows to dispense with the use of a cationic polymer of a high molecular weight or a polyvalent metal salt, which is often employed in the conventional art, or to minimize such use, since such substance is only required in supplemental manner for further enhancing the effect of the present invention. As a result, the present invention can attain another advantage of avoiding the loss in the color generating ability of the dye, encountered conventionally in case such cationic polymer or polyvalent metal salt is employed for improving the water resistance.

In the exploitation of the present invention, there is no particular limitation on the printing material to be employed, and so-called plain paper such as ordinary copy paper or bond paper can be advantageously employed for this purpose. Naturally there can also be advantageously employed the coated paper or the transparent film for overhead projector, prepared specifically for ink jet printing, and the ordinary quality paper or lustrous paper.

Among various ink jet printing methods, the present invention brings about a particular advantage when applied to a recording head or a printer of a system utilizing thermal energy for ink discharge, proposed by Canon Inc., since such system can achieve a higher density and a higher definition in the recording.

The principle and representative configuration of such system is preferably based on the basic principle disclosed for example in the U.S. Pat. Nos. 4,723,129 and 4,740,796. This system is applicable to so-called on-demand recording or continuous recording, but is particularly effective in the on-demand recording because, in response to the application of at least a drive signal representing the recording information to an electrothermal converting element positioned corresponding to a liquid channel or a sheet containing liquid (ink) therein, the element generates thermal energy capable of causing a rapid temperature increase exceeding the nucleus boiling point, thereby inducing film boiling on a heat action surface of the recording head and thus forming a bubble in the liquid (ink), in one-to-one correspondence with the drive signal. The liquid (ink) is discharged through a discharge port by the growth and contraction of the bubble, thereby forming at least a liquid droplet. The drive signal is preferably formed as a pulse, as it realizes instantaneous grow and contraction of the bubble, thereby attaining highly responsive discharge of the liquid (ink). Such pulse-shaped drive signal is preferably that disclosed in the U.S. Pat. Nos. 4,463,359 and 4,345,262. Also the conditions described in the U.S. Pat. No. 4,313,124 relative to the temperature increase rate of the heat action surface allows to obtain further improved recording.

The configuration of the recording head is given by the combinations of the liquid discharge ports, liquid channels and electrothermal converting elements with liner or rectangular liquid channels, disclosed in the above-mentioned patents, but a configuration disclosed in the U.S. Pat. No. 4,459,600 also belongs to the present invention.

In the range of serial recording head, the present invention is effective in a recording head fixed to the main apparatus, or a recording head of interchangeable chip type, which can receive ink supply from the main apparatus and can be electrically connected therewith upon mounting on the main apparatus, or a recording head of cartridge type in which an ink cartridge is integrally constructed with the recording head.

Also with respect to the kind or number of the printing heads, the present invention is not limited to a single recording head corresponding to the ink of a single color, but also covers the use of plural recording heads corresponding to plural inks different in color or in density. More specifically, the present invention is not limited to a recording mode for recording a single main color such as black, but is extremely effective also to the apparatus having at least one of the recording modes with plural different color or with full color by color mixing, wherein the recording head is either integrally constructed or is composed of plural units.

Furthermore, the ink jet printing apparatus of the present invention may be formed, in addition to an image output terminal for an information processing apparatus such as a computer, as a copying apparatus in combination with an image reader or the like or as a facsimile apparatus having transmitting and receiving functions.

As explained in the foregoing, the present invention provides an ink jet recording head of a high image quality with a high printing speed, and an ink jet recording head and an ink jet printing apparatus which allow easy adjustment of the reaching position of the recording head, are featured by the reduced cost and by the image fastness, image fixation, image density and head durability.

What is claimed is:

1. A liquid discharging head for discharging liquid from a plurality of first and second discharge ports, comprising:

first and second element boards provided in mutually opposed manner, said first element board bearing thereon a plurality of first energy generating elements for generating energy to discharge liquid from said first discharge ports, and said second element board bearing thereon a plurality of second energy generating elements for generating energy to discharge liquid from said second discharge ports; and a grooved member positioned between said mutually opposed first and second element boards and unified integrally with a face member provided with said first discharge ports and said second discharge ports, said grooved member being provided on one side with a plurality of first grooves for forming first liquid flow paths respectively corresponding to said first energy generating elements and communicating with said first discharge ports in combination with said first element board and on an other side a plurality of second grooves for forming second liquid flow paths respectively corresponding to said second energy generating elements and communicating with said second discharge ports in combination with said second element board, said first element board and said second element board contacting to a back side of said face member.

2. A liquid discharging head according to claim 1, wherein the discharge ports corresponding to said first element board are adapted to discharge ink, and the discharge ports corresponding to said second element board are adapted to discharge processing liquid.

3. A liquid discharging head according to claim 2, wherein said processing liquid contains a cationic substance consisting of a low-molecular component and a high-molecular component, and said ink at least contains an anionic dye and a pigment.

4. A liquid discharging head cartridge comprising:

a liquid discharging head according to claim 1; and a liquid container for containing ink to be supplied to said liquid discharging head.

5. A liquid discharging head according to claim 1, wherein said grooved member has a recess portion constituting a common liquid chamber for supplying liquid to said liquid flow paths, corresponding to said each element board.

6. A liquid discharging head according to claim 1, wherein the discharge ports corresponding to said first element board and the discharge ports corresponding to said second element board are provided on a same plane.

7. A liquid discharging head according to claim 2, further comprising means for avoiding mixing of the ink and the processing liquid, between the discharge ports corresponding to said first element board and the discharge ports corresponding to said second element board.

8. A liquid discharging head according to claim 1, wherein said discharge ports are arranged in a first array corresponding to said first element board and a second array corresponding to said second element board and said first array and said second array are provided in mutually parallel manner and perpendicularly to a scanning direction of the liquid discharging head.

9. A liquid discharging head according to claim 1, wherein said discharge ports are arranged in a first array corresponding to said first element board and a second array corresponding to said second element board and said first array and said second array are provided in mutually parallel manner and inclined with respect to a scanning direction of the liquid discharging head.

10. A liquid discharging head according to claim 9, wherein, with respect to said first array of the discharge ports, said second array of the discharge ports are displaced by a predetermined pitch along the direction of said second array in such a manner that an imaginary line passing through a predetermined discharge port in said first array of the discharge ports and extending in the scanning direction of said head coincides with an imaginary line passing through a predetermined discharge port in said second array of the discharge ports and extending in the scanning direction of said head.

11. A liquid discharging head according to claim 1, wherein said first and second element boards are different in shape thereof.

12. A liquid discharging head according to claim 1, wherein the energy generating elements provided on said first and second element boards are different in the characteristics thereof.

13. A liquid discharging head according to claim 1, wherein the liquid flow paths provided respectively corresponding to said first and second element boards are different in shape thereof.

14. A liquid discharging head according to claim 2, wherein said processing liquid contains a cationic substance consisting of a low-molecular component and a high-molecular component, and said ink contains an anionic dye.

15. A liquid discharging apparatus comprising:

a liquid discharging head according to claim 1; and means for detachably supporting said liquid discharging head.

16. A liquid discharging apparatus according to claim 15, further comprising:

means for transporting a recording medium for receiving the ink discharged from said liquid discharging head; and means for transporting said liquid discharging head.

17. A liquid discharging head according to claim 1, wherein said preventing means comprises at least one of a groove and a protruding portion.

18. A liquid discharging head according to claim 1, further comprising preventing means for preventing mixing of liquids discharged from both said first and said second discharge ports, said preventing means being provided between said first and said second discharge ports on the face.

* * * * *

UNITED STATES PATENT AND TRADEMARK OFFICE

CERTIFICATE OF CORRECTION

PATENT NO. : 6,179,412 B1
DATED : January 30, 2001
INVENTOR(S) : Hiroyuki Ishinaga et al.

It is certified that error appears in the above-identified patent and that said Letters Patent is hereby corrected as shown below:

Column 2,
Line 24, "his" should be deleted.

Column 5,
Line 8, "reference" should read -- reference to --; and
Line 9, "of" should read -- of a --.

Column 10,
Line 39, "grow" should read -- growth --.

Signed and Sealed this

Sixteenth Day of April, 2002

*Attest:*

*Attesting Officer*

JAMES E. ROGAN
*Director of the United States Patent and Trademark Office*